United States Patent [19]

Yasuoka et al.

[11] 4,042,851

[45] Aug. 16, 1977

[54] MAGNETRON

[75] Inventors: Yoshio Yasuoka, Hirakata; Fumihiko Ito, Otsu; Kunitada Tsuboi; Kaori Jinno, both of Daito; Masaru Yamano, Hirakata, all of Japan

[73] Assignee: Sanyo Electric Co., Ltd., Moriguchi, Japan

[21] Appl. No.: 608,402

[22] Filed: Aug. 27, 1975

[30] Foreign Application Priority Data

July 30, 1975 Japan ..... 50-93626

[51] Int. Cl.[2] ..... H01J 25/50

[52] U.S. Cl. ..... 315/39.51; 315/39.71; 315/39.77

[58] Field of Search ..... 315/39.51, 39.53, 39.71, 315/39.77

[56] References Cited

U.S. PATENT DOCUMENTS

| | | | |
|---|---|---|---|
| 3,346,766 | 10/1967 | Feinstein | 315/39.71 |
| 3,376,466 | 4/1968 | Gerard | 315/39.77 X |
| 3,377,562 | 4/1968 | Staats | 315/39.51 X |
| 3,412,285 | 11/1968 | Gerard | 315/39.77 X |
| 3,543,082 | 11/1970 | Boehm | 315/39.53 X |
| 3,588,588 | 6/1971 | Numata | 315/39.53 |
| 3,843,904 | 10/1974 | Brown | 315/39.71 |
| 3,855,498 | 12/1974 | MacMaster et al. | 315/39.71 |
| 3,881,127 | 4/1975 | MacMaster et al. | 315/39.71 |
| 3,984,725 | 10/1976 | Cook et al. | 315/39.71 |

FOREIGN PATENT DOCUMENTS

| | | | |
|---|---|---|---|
| 427,954 | 5/1935 | United Kingdom | 315/39.71 |

*Primary Examiner*—Saxfield Chatmon, Jr.
*Attorney, Agent, or Firm*—Darby & Darby

[57] ABSTRACT

A magnetron constructed by locating a pair of permanent magnets in a vacuum container which is an anode cylinder (i.e. shell) of magnetic material and has upper and lower covers of magnetic material to form a magnetic circuit. A high frequency resonator is formed by attaching anode vanes directly to the internal wall of the anode cylinder and providing a film of highly conductive material on the internal wall of the anode cylinder between the anode vanes. Terminals for the supply of power to a cathode disposed between the permanent magnets pass through a hole in at least one of the permanent magnets and one of the covers of the magnetic material. An antenna, or probe, extends out of a hole in the side wall of the anode cylinder, and heat radiative fins are attached directly to the external wall of the anode cylinder.

11 Claims, 2 Drawing Figures

MAGNETRON

BACKGROUND OF THE INVENTION

In a conventional magnetron, as shown in FIG. 1, a pair of permanent magnets 1*a*, 1*b* are disposed outside an anode cylinder (i.e. shell) 2 of antimagnetic and highly electrically conductive material, and they supply a magnetic field to an operative space 3 surrounded by anode vanes 4 through a pair of yokes 5*a*, 5*b* and circular magnetic pieces 6*a*, 6*b*. The vanes 4 are directly attached to the anode cylinder 2, and a pair of yokes 5*a*, 5*b* support the permanent magnets 1*a*, 1*b*. Circular magnetic pieces 6*a*, 6*b* support the anode cylinder 2. There is a directly heated spiral cathode 7 at the center of the operative space 3. As the size of the magnetron increases the magnetic resistance also increases because the magnetic circuit becomes long. Therefore, the permanent magnets 1*a*, 1*b* must be made large in order to supply the necessary desired magnetic field to the operative space 3. Furthermore, the area of the external wall of the anode cylinder 2 to which the usual heat radiative cooling fins may be attached is restricted by the existence of the permanent magnets 1*a*, 1*b*.

An improved magnetron for overcoming the defects described above, is the so-called internal magnet magnetron which is made by constructing the anode cylinder of magnetic material, locating a pair of permanent magnets in the anode cylinder, which is also a vacuum container, and making the anode cylinder a part of the magnetic circuit. This magnetron has advantages in that it is possible to reduce the size of the permanent magnets because the gap between the magnets and the operative space may be made small and the magnetic field may be intensified. Further, the leakage of the magnetic flux is made almost zero because the anode cylinder is a vacuum container and a part of the magnetic circuit itself. However, an internal magnet magnetron has a disadvantage in that the losses of the cavity resonator, which comprises anode vanes and the anode cylinder, at high frequency becomes large because the anode cylinder is made of magnetic material like iron.

PURPOSE OF THE INVENTION

The object of this invention is to provide a magnetron in which the sizes of the permanent magnets are reduced, the size of the entire magnetron is also reduced, the leakage of the magnetic flux is diminished, the loss of the resonator at high frequency is also diminished, and the heat radiative, i.e. cooling, efficiency is improved.

DETAILED DESCRIPTION OF THE INVENTION

Figure 1:
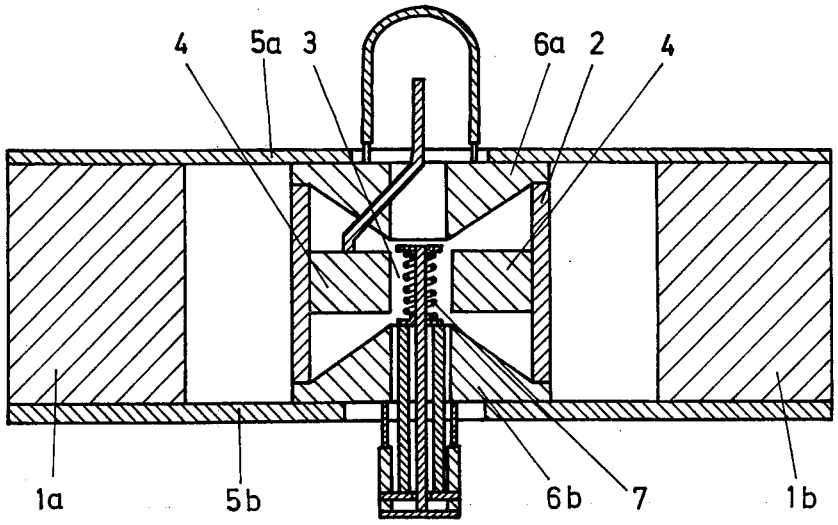
FIG. 1 is a cross-sectional view of one example of a conventional magnetron.

This invention is fully described hereinafter with reference to the drawing.

Figure 2:
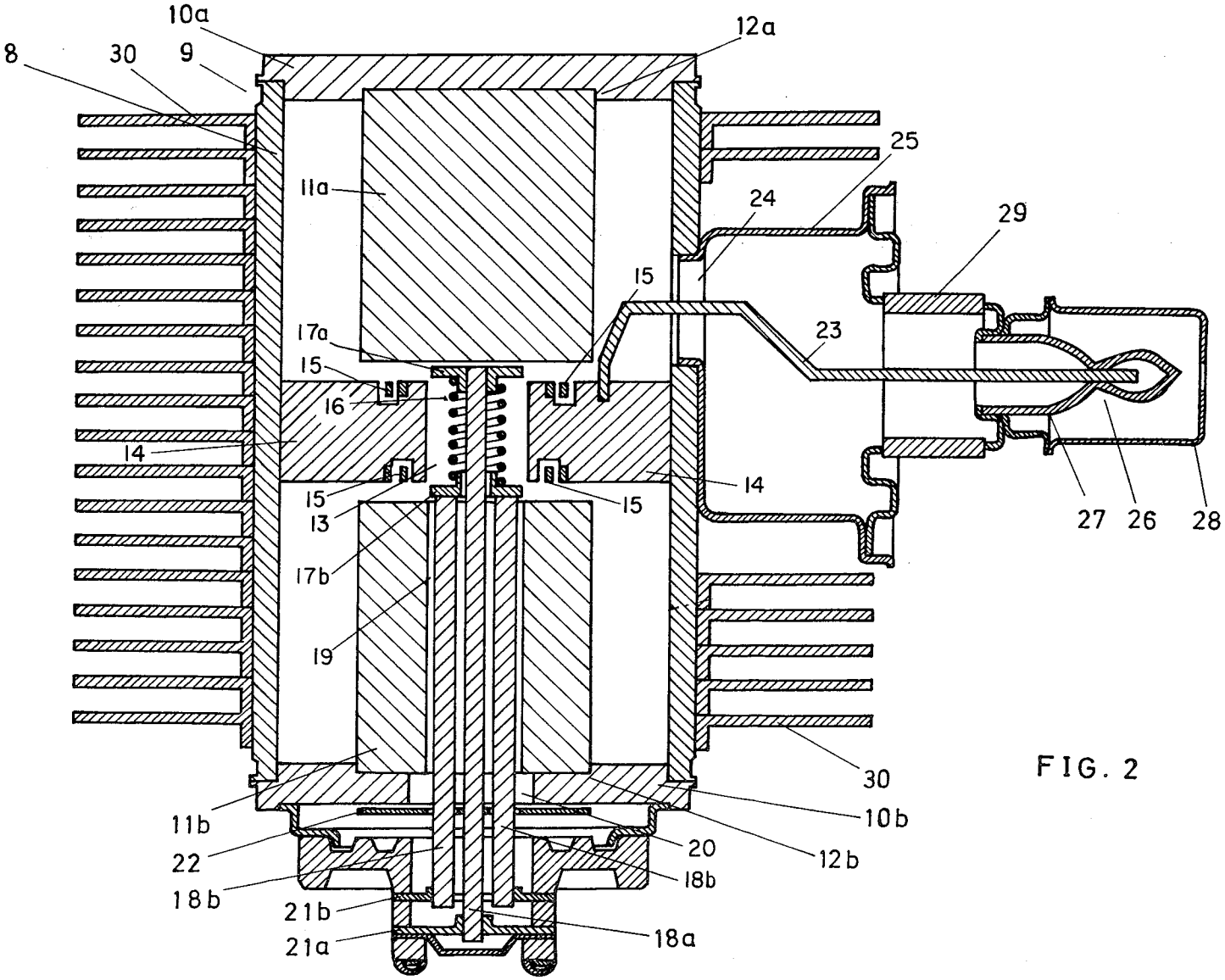
FIG. 2 is a cross-sectional view of one example of a magnetron of this invention.

In FIG. 2, numeral 8 indicates an anode cylinder (i.e. shell) of magnetic material, for example, iron or an iron alloy. The anode cylinder 8 is a vacuum container 9 itself and is made a part of magnetic circuit. 10*a*, 10*b* indicate a pair of magnetic boards made of iron or other similar magnetic material, and they constitute the upper and lower covers of the vacuum container 9. They also form parts of the magnetic circuit including the anode cylinder 8.

Numerals 11*a*, 11*b* indicate a pair of permanent magnets, for example, Fe-Cr-Co magnets which are made by forging after melting in a vacuum, or Al-Ni-Co magnets made by casting. The former is, however, preferred over the latter because Fe-Cr-Co magnets will generate less gas than Al-Ni-Co magnets in the vacuum container 9. Magnets 11*a*, 11*b* are mounted in hollows 12*a*, 12*b* in the upper and lower covers 10*a*, 10*b* and fixed to them, for example by spot welding at about three points on each circle of engagement. Magnets 11*a*, 11*b* supply a magnetic field to the operative space 13 between them.

Numerals 14 indicate a plurality of anode vanes of highly electrically conductive material such as copper and the like, and they are directly and radially attached to the internal wall of the anode cylinder 8, for example by silver soldering or other process. Strap rings 15 are used to short circuit selected, usually alternate, anode vanes in order to stabilize the oscillation frequency. A thin film of high conductive material, for example, like silver solder, copper plating, or silver plating whose thickness is greater than the skin depth is placed on the internal wall of the anode cylinder 8. The cavity resonator is formed by the anode vanes 14 and the anode cylinder 8 with the thin film.

A directly heated spiral cathode 16 which is, for example, made of ThW and the like, is disposed at the center of the operative space 13 which is surrounded by the permanent magnets 11*a*, 11*b* and the anode vanes 14. A pair of end shields 17*a*, 17*b* support the cathode 16 from both sides and are also electrically connected to the cathode. An electrically conductive supporting bar 18*a* supports the cathode 16 and transmits electric power in order to heat it. The supporting bar 18*a* is inserted through the holes 19, 20 in the permanent magnet 11*b* and the lower cover of the magnetic board 10*b*. One end of bar 18*a* is connected to the end shield 17*a* and the other end is connected to a terminal board 21*a* for the power supply. Other supporting bars 18*b*, 18*b* also support the cathode 16 and transmit electric power to heat it. They are also inserted through the holes 19, 20, and one of each of their end is connected to the other end shield 17*b*. The other ends of each of bars 18*b*, 18*b* is connected to another terminal board 21*b* for the power supply. It is possible to heat the directly heated spiral cathode 16 through the supporting bars 18*a*, 18*b*, 18*b* and the end shields 17*a*, 17*b* by applying a biasing voltage between the terminal boards 21*a*, 21*b* from a power supply (not shown).

An electrically conductive choke disk 22 is provided outside and near the lower magnetic board 10*b* of the vacuum container 9 and it is fixed to the supporting bar 18*b*, in spaced relationship by an insulator 21*b*. The choke disk 22 provides an electrostatic capacitance of large value with the lower magnetic board 10*b*, and the microwave energy is short-circuited at high frequency by the capacitance. Leakage of the microwave energy is prevented in this way.

Furthermore, numeral 23 indicates a coupling probe, or antenna, whose one end is connected to one of the anode vanes 14, and whose other end passes out of a hole 24 which is provided through the side wall of the anode cylinder 8. An antenna cavity 25 is electrically connected to the anode cylinder 8 and it surrounds the antenna 23 projecting from the anode cylinder 8. A seal 26 seals the other end of the antenna 23 and it includes an exhaust tube 27 made of conductive material for exhausting internal gases from container 9. The cap 28 provides protection for the seal 26. An insulator 29 isolates the seal 26 from the antenna cavity 25. Heat radiator fins 30 for cooling the magnetron are directly attached to the external wall of the anode cylinder 8 by any suitable process such as welding.

By the construction described above the magnetron of this invention has various features as follows:

It is possible to reduce the sizes of the permanent magnets because it is possible to intensify the magnetic field in the operative space and to reduce the leakage of the magnetic flux by containing a pair of permanent magnets in a vacuum container which consists of an anode cylinder made of magnetic material and upper and lower covers made of magnetic material, and constituting the magnetic circuit by the anode cylinder, upper and lower covers, both of the permanent magnets, and the operative space between the magnets. It is also possible to gain a high radiative efficiency, i.e. high cooling efficiency by attaching the anode vanes directly to the internal wall of the anode cylinder and attaching the heat radiator fins directly to the external wall of the anode cylinder. It is also possible to reduce the loss of the cavity resonator at high frequency by using a thin film of highly conductive material on the internal wall of the anode cylinder between the anode vanes. It is also possible to reduce the size of the magnetron as a whole and to obtain mechanical strength by bringing out the terminals of the power supply of the cathode through holes in at least one of the permanent magnets and one of the magnetic boards. It is also possible to reduce the width of the magnetron structure by taking out the antenna from a hole of the side wall of the anode cylinder.

There is no problem that deterioration of the vacuum status of the container may arise due to generation of gas from adhesive as in the case where the magnets are fixed to the upper and the lower covers by adhesive because the magnets are engaged with the hollows of the covers and fixed to them by spot welding. There is also no problem of having the effectiveness of the magnets destroyed by heating them to a temperature higher than the Curie point because the heat generated in the spot welding at several spots is diverted rapidly to other parts. It is also easy and economical to fix the magnets to the covers by spot welding.

Furthermore, it is possible to prevent leakage of microwave energy by providing a conductive choke disk with the supporting bar outside and near the lower cover of the vacuum container made of magnetic board because an electrostatic capacitance of large value is formed by the choke disk and the magnetic board which short-circuits the microwave energy at high frequency.

The magnetron of this invention is reduced in size as compared to a conventional one as follows. The size of a conventional magnetron as shown in FIG. 1 is 100 × 110 × 110 mm, and the size of the magnetron of this invention shown in FIG. 2 is 85 × 96 × 102 mm for 2450 MHz and output of 800 W.

As described above, the film of highly conductive material on the inside of cylinder 8 is preferably of silver solder. The production of the film of highly conductive material on the internal wall of the anode cylinder is described in the following.

At first, the anode cylinder is disposed on a foundation whose projection is inserted into the anode cylinder, and the anode vanes are disposed on the projection. Next, a ring of the highly conductive material, such as silver solder, is disposed on the anode vanes contacting the internal wall of the anode cylinder. When all of them are heated to a temperature higher than the melting point of the highly conductive material, only the ring will melt and the material, now in liquid form, soaks between the edges of the anode vanes and the anode cylinder. It also flows on the internal wall of the anode cylinder between the anode vanes uniformly. When all are cooled again, the anode vanes are soldered to the anode cylinder and thin film is formed on the wall because the fluid is solidified again. It is possible to obtain a film of desired thickness by regulating the size of the ring and the temperature at which the soldering takes place.

What is claimed is:

1. A magnetron having a substantially evacuated interior region and comprising:

an anode cylinder of magnetic material;

a plate of magnetic material at each end of the anode cylinder cooperating therewith to form a magnetic circuit and at least a portion of a vacuum container, said vacuum container enclosing said evacuated region, permanent magnet means mounted to each of said plates and extending partially into the anode cylinder leaving a space between their opposing ends, cathode means located in the space between said permanent magnet means, anode circuit means surrounding said cathode, an electrically conductive supporting means for holding said cathode means, said supporting means extending through a hole in one of said permanent magnets and the plate to which it is attached, antenna means extending through a sealed hole in the wall of the anode cylinder, heat radiator fins directly attached to the external wall of said anode cylinder, and choke means disposed in said evacuated region and comprising means in proximity to one of said end plates and forming a capacitor therewith for preventing leakage of electromagnetic energy from the magnetron.

2. A magnetron as in claim 1 wherein each said end plate is provided with a depression and the respective permanent magnet is welded to the plate in the depression.

3. A magnetron as in claim 1 wherein said choke means is formed with the plate of magnetic material through which said supporting means for said cathode means extends.

4. A magnetron as in claim 1 wherein said choke means includes a plate which is generally parallel to the plate of magnetic material at the end of the anode cylinder.

5. A magnetron as in claim 1 wherein said choke means includes a choke plate which is attached to the supporting means for the cathode means to be substantially parallel with and spaced from the magnetic plate through which said supporting means extends to form the capacitor with said magnetic plate, the space between said choke plate and said magnetic plate being free of any insulating material, thereby permitting close spacing of said plates.

6. A magnetron as in claim 1 wherein said anode circuit means comprises a plurality of anode vanes attached to the inner wall of said anode cylinder and extending inwardly into the space between the permanent magnet means and leaving a spacing between the vanes.

7. A magnetron as in claim 1 further comprising a film of highly electrically conductive material on the internal wall of the anode cylinder between the anode vanes.

8. A magnetron as in claim 7 in which said film of highly electrically conductive material includes silver.

9. A magnetron comprising:

an anode cylinder of magnetic material, a plate of magnetic material at each end of the anode cylinder forming a magnetic circuit and a vacuum container with the anode cylinder, permanent magnet means mounted to each of said plates and extending partially into the anode cylinder leaving a space between their opposing ends, a plurality of anode vanes attached directly to the inner wall of the anode cylinder and extending inwardly into the space between the permanent magnet means and leaving a space between the vanes, cathode means located in the space between said permanent magnet means, an electrically conductive supporting means for holding said cathode means, said supporting means extending through a hole in one of said permanent magnets and the plate to which it is attached, antenna means extending through a sealed hole in the wall of the anode cylinder, heat radiator fins directly attached to the external wall of said anode cylinder, and choke means comprising means in proximity to one of said end plates and forming a capacitor therewith for preventing leakage of electromagnetic energy from the magnetron.

10. A magnetron as in claim 9 further comprising a film of highly electrically conductive material on the internal wall of the anode cylinder between the anode vanes.

11. A magnetron as in claim 10 in which said film of highly electrically conductive material includes silver.

* * * * *